United States Patent [19]

Turner

[11] Patent Number: 4,516,875

[45] Date of Patent: May 14, 1985

[54] CONCRETE SLAB KEY JOINT FORMING STRIP AND SUPPORTING STAKE THEREFOR

[75] Inventor: Frank E. Turner, San Mateo, Calif.

[73] Assignee: The Burke Company, San Mateo, Calif.

[21] Appl. No.: 479,355

[22] Filed: Mar. 28, 1983

[51] Int. Cl.[3] ..... E01C 11/04

[52] U.S. Cl. ..... 404/50; 404/68; 52/155; 52/365; 249/3

[58] Field of Search ..... 404/48, 50, 51, 68; 249/2, 3, 9; 52/78, 364, 365, 155; 256/52, DIG. 5; 403/346, 347, 387

[56] References Cited

U.S. PATENT DOCUMENTS

| | | | |
|---|---|---|---|
| 200,206 | 2/1878 | Langham | 52/155 |
| 277,658 | 5/1883 | Arthur et al. | 52/155 |
| 312,524 | 2/1885 | Smolley | 52/155 |
| 1,400,455 | 12/1921 | Peterson | 256/52 X |
| 2,029,739 | 2/1936 | Pavek | 256/52 |
| 2,297,288 | 9/1942 | Brinson | 256/52 |
| 2,498,623 | 2/1950 | Poupitch | 248/223.3 X |
| 3,037,730 | 6/1962 | Knoll et al. | 248/221.3 X |
| 3,057,269 | 10/1962 | Artigalas et al. | 404/50 |
| 3,143,783 | 8/1964 | Gaetke | 404/51 |
| 3,193,225 | 7/1965 | Terlinde | 248/221.3 |
| 3,228,152 | 1/1966 | Wilbourn | 52/78 |
| 3,288,042 | 11/1966 | Gaetke | 249/3 X |
| 3,300,920 | 1/1967 | Skaare | 249/3 X |
| 3,429,241 | 2/1969 | Burton | 404/51 |
| 3,437,018 | 4/1969 | Jackson | 404/50 |
| 3,451,180 | 6/1969 | Struben | 52/78 X |
| 3,561,721 | 2/1971 | Self | 249/9 |
| 3,628,764 | 12/1971 | Burton | 249/9 |
| 3,770,237 | 11/1973 | Burton | 249/3 |
| 3,784,313 | 1/1974 | Collier, Jr. | 404/51 |
| 4,012,024 | 3/1977 | Courtois | 404/50 X |
| 4,012,159 | 3/1977 | Berry | 404/50 X |
| 4,189,796 | 2/1980 | Gutner | 248/221.3 |
| 4,202,145 | 5/1980 | Coulter et al. | 249/3 X |
| 4,411,404 | 10/1983 | Weisbach | 249/3 |
| 4,428,556 | 1/1984 | Parsons et al. | 249/3 |
| 4,443,981 | 4/1984 | Weiss | 404/68 X |

FOREIGN PATENT DOCUMENTS

| | | | |
|---|---|---|---|
| 2114729 | 7/1930 | Australia | 256/52 |
| 2446630 | 4/1976 | Fed. Rep. of Germany | 248/490 |
| 1446448 | 6/1966 | France | 248/223 B |

OTHER PUBLICATIONS

"Snaplock" Screed and Anchor Slot Tech. Manual, Chapman.

*Primary Examiner*—James A. Leppink
*Assistant Examiner*—Beverly E. Hjorth
*Attorney, Agent, or Firm*—Limbach, Limbach & Sutton

[57] ABSTRACT

A key joint forming strip and supporting stake therefor wherein the upper portion of the strip includes a hook segment engageable with a supporting ledge on the upper end of the stake and the intermediate portion of the stake includes a downwardly facing hook engageable with a protrusion on a lower portion of the strip. In use, the hook segment is first engaged with the ledge and then the lower portion of the strip is forced against the stake to engage the protrusion beneath the downwardly facing hook. Once so engaged, the strip is held in place between the ledge and the hook.

19 Claims, 22 Drawing Figures

CONCRETE SLAB KEY JOINT FORMING STRIP AND SUPPORTING STAKE THEREFOR

BACKGROUND OF THE INVENTION

The present invention relates to the art of forming key joints between adjacent concrete slabs and, more particularly, is directed to an improved joint forming strip and supporting stake for the strip. In its more specific aspects, the invention is concerned with a strip and stake construction which provides for securing of the strip against separation from the stake, without the necessity of special crimping techniques, or separate fasteners.

Stake supported strips for forming key joints between adjacent concrete slabs are well-known in the prior art. Such strips may be seen, for example, in U.S. Pat. Nos. 3,143,783 and 3,288,042, both of which show strips which provide a thin line at the surface of the concrete slabs. The '042 patent is particularly interesting, in that it is provided with a crimping tool to secure the strip against separation from the stake. Another example of such a strip may be seen in U.S. Pat. No. 3,057,269, which patent shows a strip and stake combination wherein the stake is provided with an upwardly extending tab to support the lower edge of the strip.

SUMMARY OF THE INVENTION

The stakes of the present invention each have a strip supporting ledge at the upper end thereof and a downwardly facing hook member intermediate the length thereof. The strip has a longitudinally extending generally planar upper portion with a hook segment on one side thereof engageable with the supporting ledges of the stakes. A longitudinally extending key forming channel extends laterally from the side of the planar upper portion opposite the side from which the hook segment extends, and a longitudinally extending protrusion depends from the channel. The protrusion is disposed so as to engage beneath the hook members when the hook segment is suspended on the ledge.

A principal object of the invention is to provide an improved strip and supporting stake construction for forming key joints between adjacent concrete slabs, which construction provides for securing of the strip against separation from the stake, without the necessity of employing crimping tools or separate attachments, such as clips, rivets, nails, etc.

Another object of the invention is to provide such a construction wherein the strip and stake have vertically spaced interengageable means to suspend the strip from the stake and lock the strip against separation from the stake.

Still another object of the invention is to provide such a construction wherein the strip may be secured to the stake by simply hooking the upper end of the strip over the top of the stake and then swinging the strip against the stake.

Yet another object of the invention is to provide an improved stake construction which is of high strength and provides a surface which may be hammered to adjust the grade level of the stake, even when a strip is engaged over the stake.

A further object of the invention is to provide such a stake which is designed to accommodate key joint forming strips of different heights.

Another object of the invention is to provide an improved key joint forming strip which employs rolled and folded edges which serve to strengthen the strip and facilitate its attachment to the stake.

Still a further object of the invention is to provide a key joint forming strip wherein the surfaces of the strip are designed to prevent concrete spalling in the event of a separation of concrete slabs between which the strip is disposed.

Yet another object of the invention is to provide alternative stake constructions which offer varying degrees of economy and strength, and resist drifting upon being driven to grade level.

The foregoing and other objects will become more apparent when viewed in light of the following detailed description and accompanying drawings.

DESCRIPTION OF THE FIRST EMBODIMENT

Figure 1:
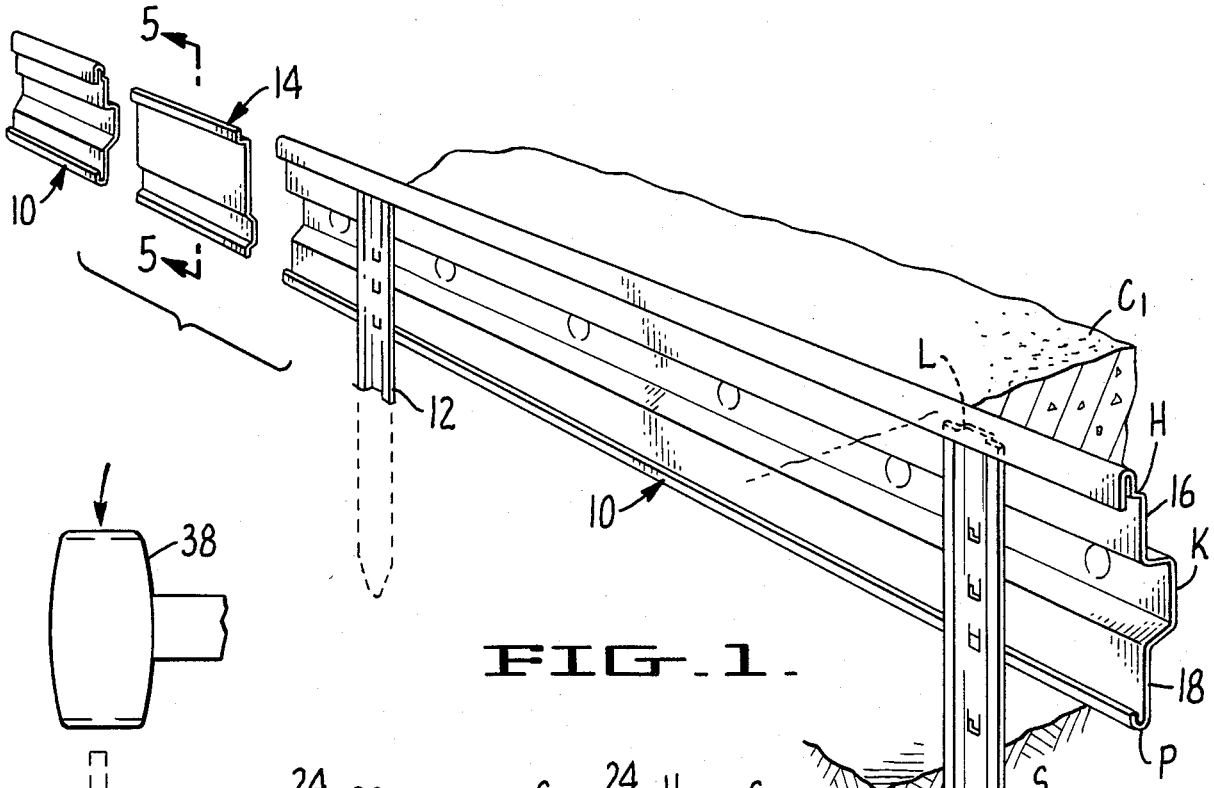
FIG. 1 is a perspective view of a first embodiment of the inventive strip and stake construction, illustrating a pair of stakes set at grade level, with a strip suspended therefrom and a concrete slab poured to one side of the strip.

Referring to FIG. 1, the strip is designated by the numeral 10 and the stakes by the numeral 12. The stakes are supported in the soil "S" and positioned as to be transversely aligned and disposed at the desired grade level. Concrete slab "$C_1$" is disposed to one side of the strip. To the left of FIG. 1, a second strip is shown in aligned exploded perspective relation to the first strip. The second strip, also designated 10, is identical to the first and is joined thereto by splicing plate 14, as may be seen in more detail in FIG. 5.

Figure 6:
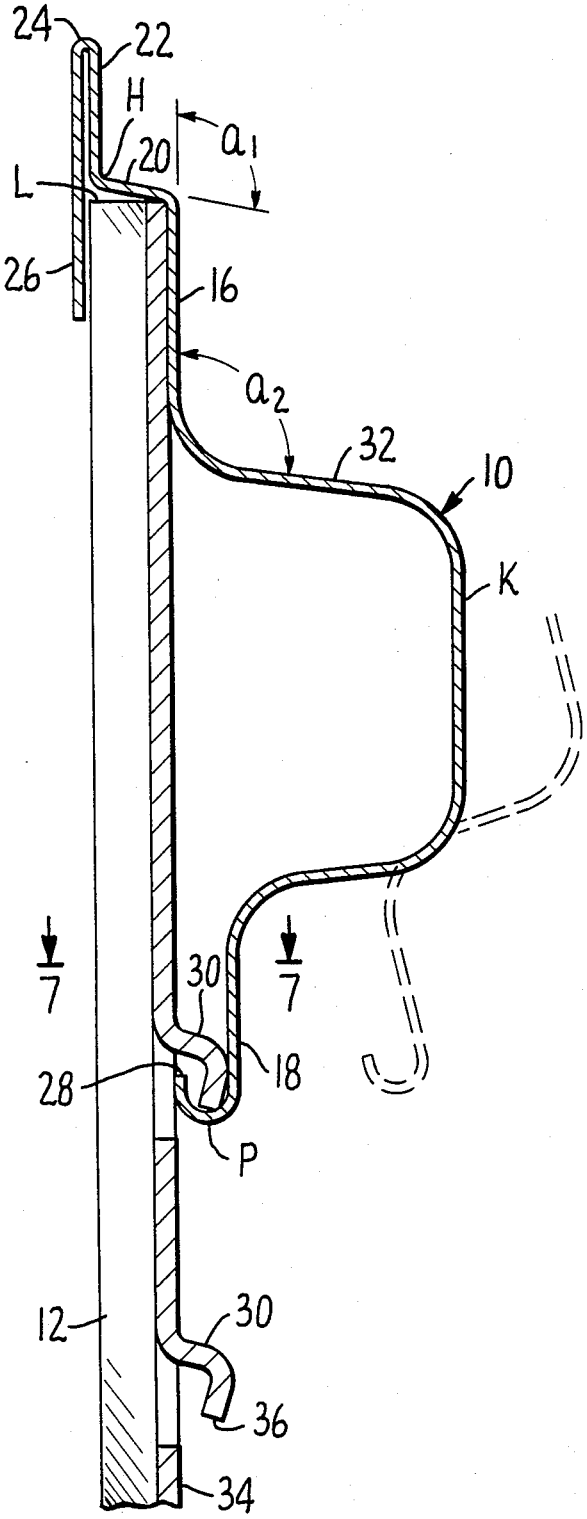
FIG. 6 is a cross-sectional elevational view of the first embodiment stake and strip, with phantom and solid line representations showing the strip being moved into engagement with a hook member intermediate the length of the stake.

The strip 10 is fabricated of folded galvanized sheet metal, as is customary for key joint forming strips of the type in question. The strip comprises: a longitudinally extending generally planar upper portion 16 having a downwardly extending hook segment "H" on one side thereof for engagement over the stakes 12; a longitudinally extending key forming channel "K" depending from the upper portion and extending laterally from the side thereof opposite said one side; and a longitudinally extending protrusion "P" depending from the channel "K" through means of a planar lower portion 18. The detailed construction of the strip is shown in FIG. 6 wherein it will be seen that the hook segment comprises: a first section 20 extending longitudinally of and laterally from the upper portion 16, said section terminating in a distal edge at a first fold line spaced from the upper planar portion; a second section 22 extending longitudinally from the distal edge of the first section, said second section being disposed in generally parallel relation to the upper planar portion 16 and extending beyond the first section to define a thin edge 24 to the side of the section 20 opposite that from which the portion 16 extends; and a third section 26 coplanar with and extending from and longitudinally of the second section in spaced opposed relationship to the upper planar portion 16. The protrusion "P" comprises a rolled lower edge on the strip with an upwardly facing end surface 28. The end surface 28 is positioned for locking engagement beneath hooks 30 formed intermediate the length of the stakes 12.

The upper surface of the section 20 extends at a first obtuse angle "$a_1$" relative to the planar portion 16. The upper side of the channel "K", designated 32, extends at a second obtuse angle "$a_2$" relative to the planar portion 16. The angle "$a_2$" is deliberately less than the angle "$a_1$" in order to assure that, in the event of slight movement of the slab "$C_1$" away from the strip 10, spalling of the concrete will not occur above the section 20.

Figure 9:
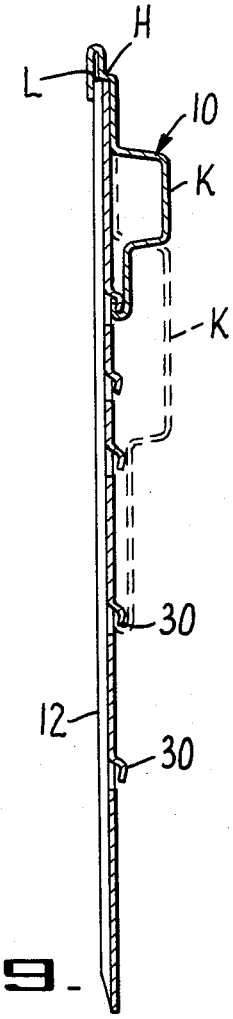
FIG. 9 is a side elevational view of the first embodiment stake and strip, illustrating, in solid and phantom line representation, how strips of different heights may be engaged with the stake.
Figure 8:
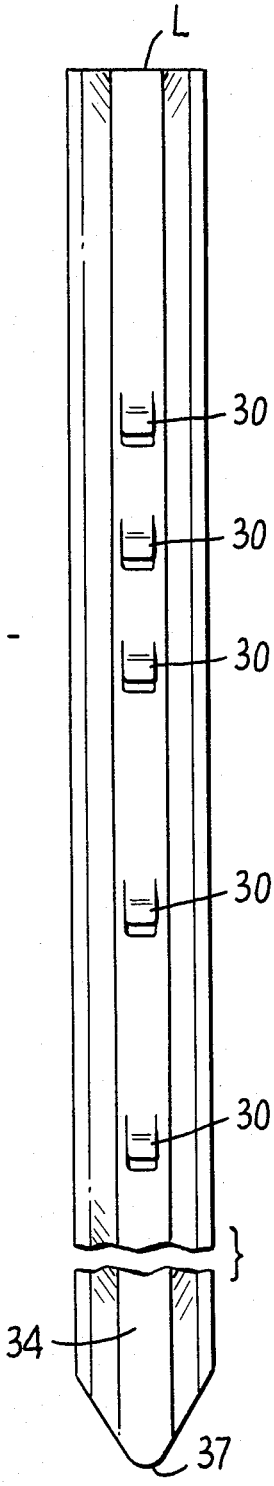
FIG. 8 is an elevational view of the side of the first embodiment stake from which the intermediate hook members extend.
Figure 10:
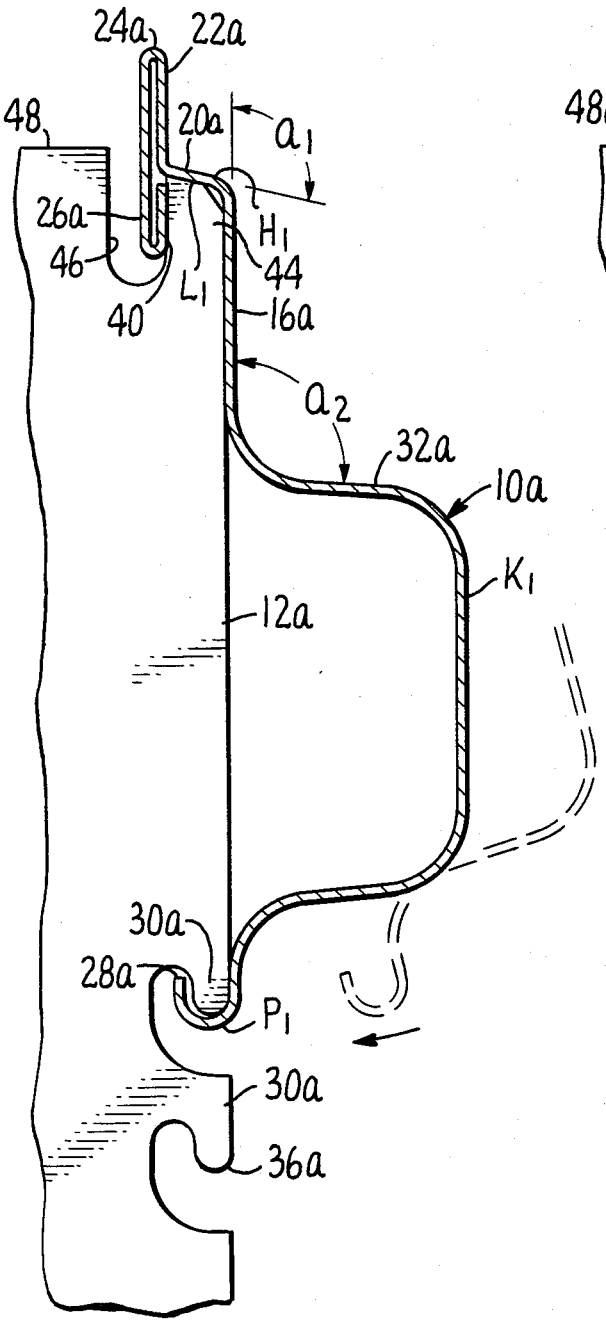
FIG. 10 is a cross-sectional elevational view of a second embodiment of the stake and strip construction, illustrating the strip in phantom and solid line representation in the process of being moved into locked engagement with the stake.

The stake 12 may be fabricated of any suitable material, such as rolled steel. It is reinforced by a longitudinally extending rib 34, from which the hooks 30 extend. As shown, the hooks 30 comprise tabs stricken from the rib, said tabs having downwardly extending distal ends 36. A plurality of tabs 30 are provided on each stake to accommodate strips of different heights, as may be seen from FIG. 9. The upper end of each stake terminates in a ledge "L" proportioned for receipt within the hook segment "H". The lower end of each stake terminates in a point 37.

Figure 2:
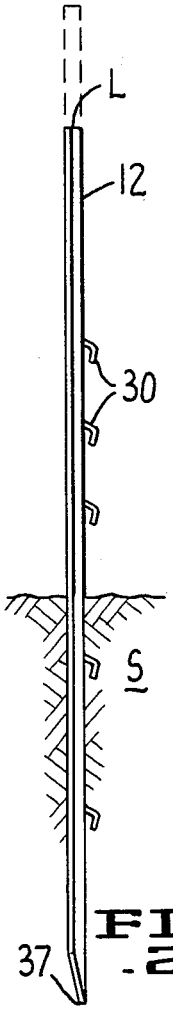
FIG. 2 is a side elevational view of the first embodiment stake in the process of being driven to grade level.
Figure 3:
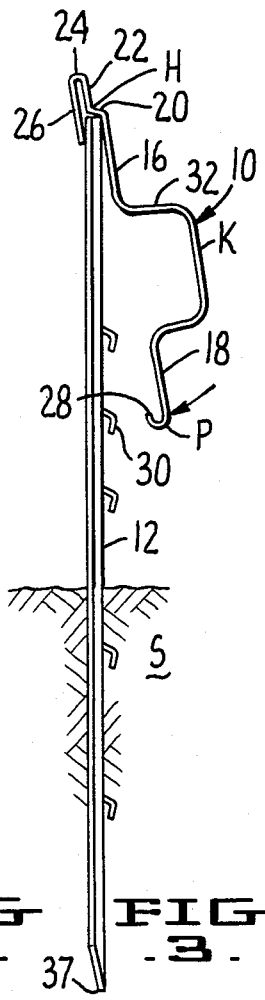
FIG. 3 is a side elevational view of the first embodiment stake in the process of having the strip attached thereto.
Figure 4:
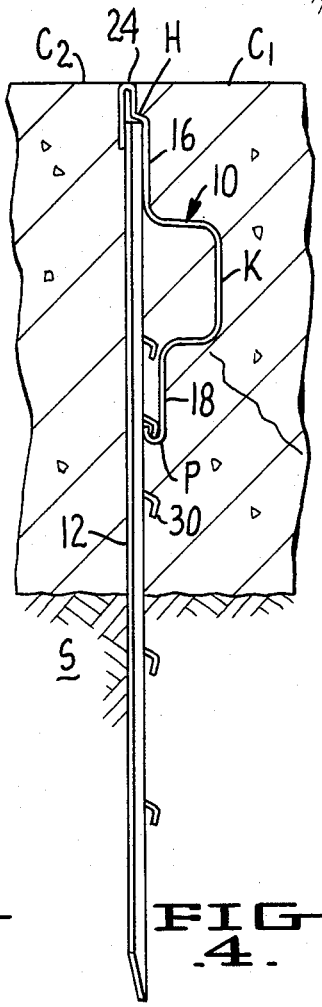
FIG. 4 is a side elevational view of the first embodiment stake and strip, with concrete slabs formed to either side of the strip.

FIG. 2 shows the step of driving the stakes to grade level. A hammer 38 is used for that purpose. FIG. 3 shows the strip in the process of being fastened to the stakes. There it will be seen that the hook segment "H" is first hooked over the ledge on the top of the stake, and then the strip is swung toward the stake to engage the protrusion "P" beneath a hook 30. FIG. 4 shows the stake and strip in place, with concrete formed to either side of the strip. As shown in FIG. 4, the slab "$C_1$" is formed to one side of the strip and the slab "$C_2$" is formed to the other side of the strip.

Figure 5:
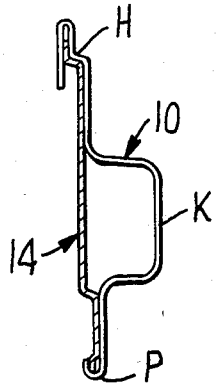
FIG. 5 is a side elevational view illustrating, in cross-section, a splicing plate which may be used to join strips of the first embodiment.

From FIG. 5, it will be seen that the splice 14 is engaged between the inside of the hook segment "H" and protrusion "P". As so received, the splice would span a pair of strips (as seen in FIG. 1) to secure the strips in alignment.

Figure 7:
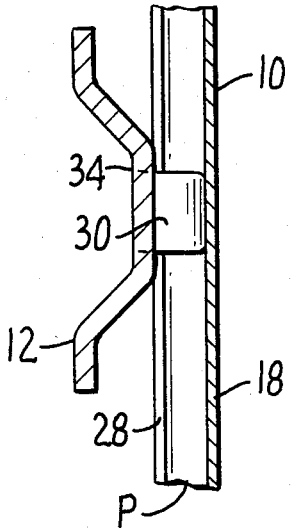
FIG. 7 is a cross-sectional view taken on the plane designated by line 7—7 of FIG. 6.

FIG. 7 illustrates that the body of the stake 12 is disposed in generally parallel relation to the strip 10, when the strip is engaged on the stake. The stake is of a generally planar configuration, as viewed from the top, with the reinforcement rib 34 extending from one side thereof.

When the strip 10 is received on the stake 12, both the elongated portion 16 and the protrusion "P" bear against the reinforcement rib of the stake. This may be appreciated from FIG. 6 wherein it will be seen that the distal lateral portion of the protrusion "P" is disposed in the same plane as the elongated upper portion 16.

DESCRIPTION OF THE SECOND EMBODIMENT

The elements of the second embodiment corresponding to those of the first embodiment are designated by like numerals or letters, followed by subscripts, as follows: strip 10*a;* stake 12*a;* planar upper portion 16*a;* first section 20*a;* second section 22*a;* thin edge 24*a;* third section 26*a;* end surface 28*a;* hooks 30*a;* upper side 32*a;* downwardly extending distal ends 36*a;* hook segment "$H_1$"; key forming channel "$K_1$"; ledge "$L_1$"; and protrusion "$P_1$". The angles "$a_1$" and "$a_2$" of the second embodiment correspond to those of the first embodiment.

The strip 10*a* of the second embodiment differs from that of the first embodiment in that the third section 26*a* of the hook segment "$H_1$" is provided with a folded over section 40 and in that a lower planar section, such as the section 18, is not provided between the channel "$K_1$" and the protrusion "$P_1$". The purpose of the folded over section 40 is to increase the rigidity of the strip 10*a.* Omission of the lower planar portion 18 reduces the amount of material required to make the strip 10*a,* without materially affecting the function of the strip. Omission of the portion 18 may actually enhance the performance of the strip, as any cracking in the concrete which may occur beneath the strip is likely to be more irregular than it would be, if a portion such as the lower planar portion 18 were present.

The stake 12*a* differs from the stake 12 in that the planar portion of the stake is designed to extend normal to the strip, and the stake is configured to accommodate such a normal relationship. This configuration includes an upwardly extending hook 44 formed at the top of the stake, which hook has a distal end defining the ledge "$L_1$" and a cutout 46 opening through the top of the stake. The ledge "$L_1$" is disposed beneath the top surface of the stake, designated 48. Thus, the top surface 48 may be driven with a hammer, without impacting on the ledge "$L_1$". The surface 48 also provides a driving surface, even when the strip 10*a* is in place.

The hooks 30*a* are defined by cutouts formed intermediate the length of the stake 12*a.* These cutouts include downwardly extending round ended hook portions, terminating in the distal ends 36*a*. In use, the protrusion "$P_1$" of the strip 10*a* snaps over these rounded ends.

DESCRIPTION OF THE THIRD EMBODIMENT

Figure 11:
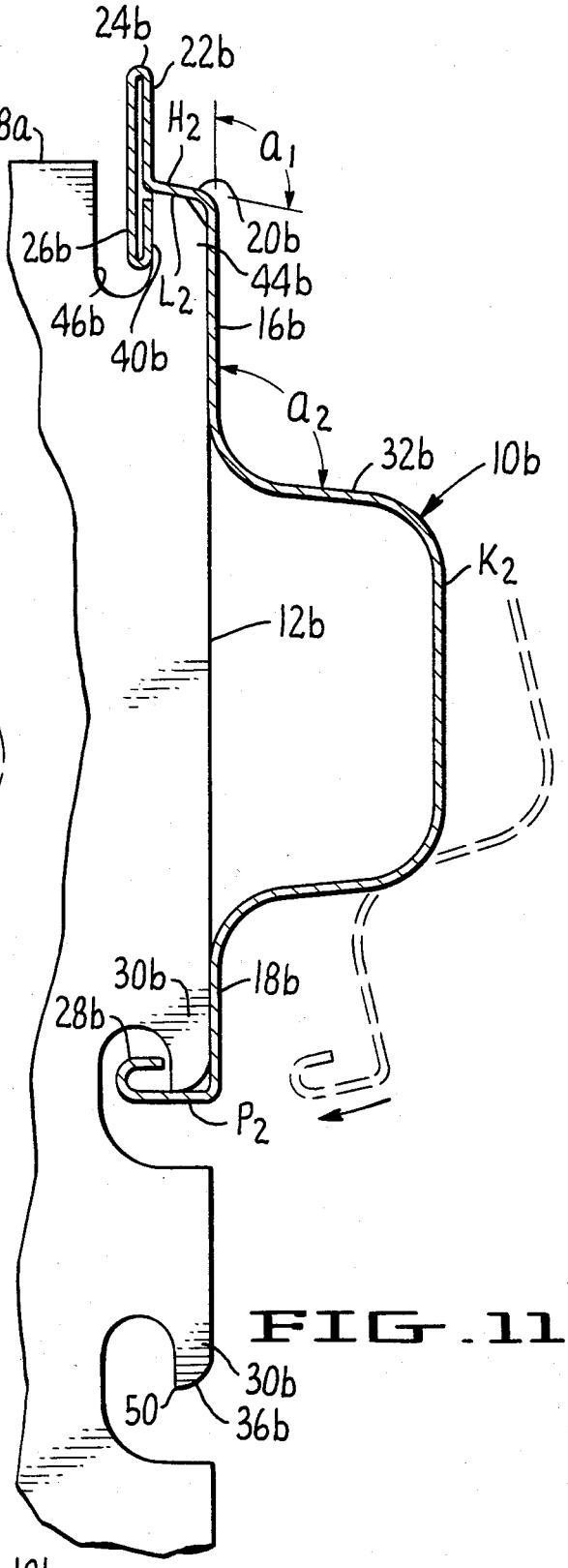
FIG. 11 is a cross-sectional elevational view of a third embodiment of the stake and strip construction, illustrating the strip in phantom and solid line representation in the process of being moved into locked engagement with the stake.

The third embodiment illustrated in FIG. 11 is very similar to the second embodiment. Elements of the third embodiment corresponding to those of the first and second embodiments are designated by like numerals and letters, followed by subscripts as follows: strip 10*b;* stake 12*b;* planar upper portion 16*b;* planar lower portion 18*b;* first section 20*b;* hooks 30*b;* upper side 32*b;* distal ends 36*b;* folded over section 40*b;* hook 44*b;* cutout 46*b;* top surface 48*b;* hook segment "$H_2$"; key forming channel "$K_2$"; ledge "$L_2$"; and protrusion "$P_2$". The angles "$a_1$" and "$a_2$" of the third embodiment correspond to the like angles of the first and second embodiments.

The third embodiment differs from the second embodiment in the following respects: a planar lower portion 18*b,* similar to the portion 18 of the first embodiment, is provided between the channel "$K_2$" and the protrusion "$P_2$"; the protrusion "$P_2$" is rolled over so that the end surface 28*b* is defined by a top surface on the rolled over portion, rather than an end edge of the sheet metal forming the strip; the downwardly extending distal ends 36*b* terminate in a sharp edge 50.

The second and third embodiments correspond identically in use. Snapping of the protrusion "$P_2$" into engagement with the hooks 30*b* is somewhat facilitated, however, because of the rolled end on the protrusion "$P_2$". Such facilitation is also enhanced by the rounded inclined outer surface 36*b*.

Figure 12:
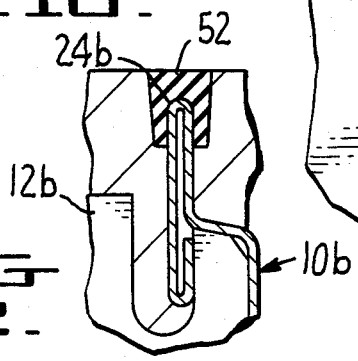
FIG. 12 is a cross-sectional elevational view illustrating an expansion joint cap on the third embodiment strip.

FIG. 12 illustrates the third embodiment with an expansion joint cap 52 on the upper end of the strip 10*b*. Such caps are generally molded of extruded plastic material and provide a somewhat enlarged joint between adjacent concrete slabs. Although the cap is shown with reference to the third embodiment, it should be understood that such a cap could be used with any of the embodiments of the present invention.

DESCRIPTION OF THE FOURTH, FIFTH, SIXTH, SEVENTH AND EIGHTH EMBODIMENTS

These embodiments are concerned only with alternative constructions for stakes which may be used with strips of the type employed in the second and third embodiments. The stakes in each case include a generally planar portion which is designed to be disposed normal to a strip supported on the stake.

Although not illustrated, it should be understood that the hooks disposed intermediate the length of the fourth, fifth, sixth, seventh and eighth embodiment stakes could have a configuration corresponding to either the hooks 30*a* or 30*b* of the second and third embodiments. The strips would cooperate with these hooks identically to the manner in which the strips 10*a* and 10*b* cooperate with the hooks.

Figure 13:
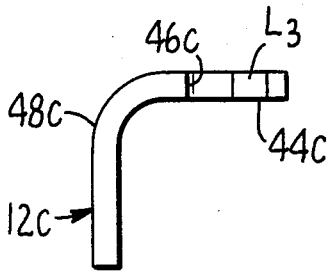
FIGS. 13 and 14 are top end and top perspective views, respectively, of a fourth embodiment stake.
Figure 14:
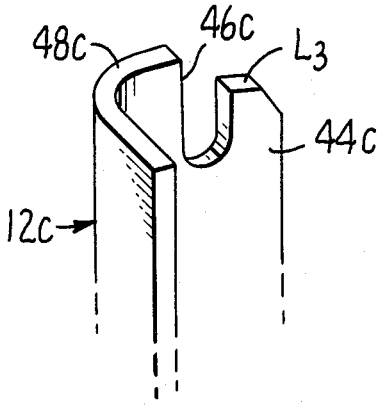

The fourth embodiment stake 12*c* illustrated in FIGS. 13 and 14 is of a round cornered L-shaped configuration. The ledge and hook structure at the top of the stake corresponds to that of the second and third embodiments and is designated by similar characters, followed by subscripts as follows: ledge "$L_3$"; hook 44*c;* cutout 46*c;* and top surface 48*c*.

Figure 15:
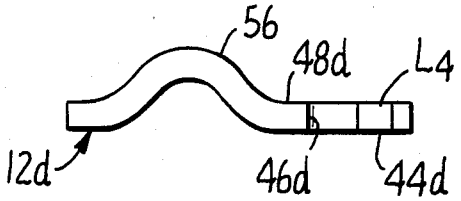
FIGS. 15 and 16 are top end and top perspective views, respectively, of a fifth embodiment stake.
Figure 16:
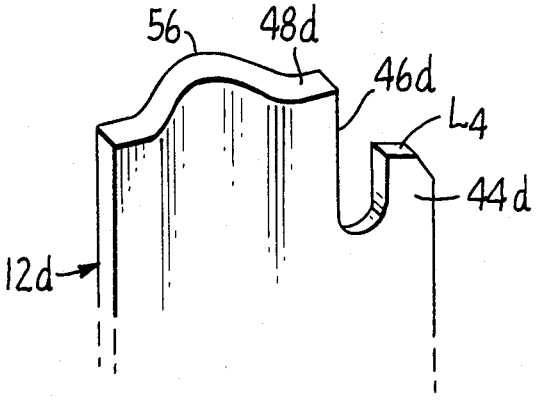
Figure 17:
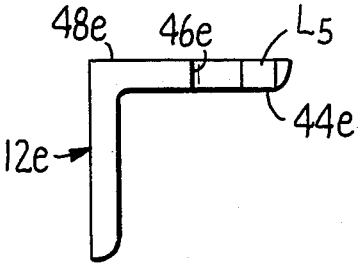
FIGS. 17 and 18 are top end and top perspective views, respectively, of a sixth embodiment stake.

The fifth embodiment stake 12*b,* illustrated in FIGS. 15 and 16, is of a generally planar configuration reinforced by a longitudinally extending rib 56. The ledge and hook structure at the top of the stake corresponds to that of the second and third embodiments and is designated by similar characters, followed by subscripts as follows: ledge "$L_4$"; hook 44*d;* cutout 46*d;* and top surface 48*d*.

The sixth embodiment stake 12*c* is of a sharp cornered L-shaped configuration. The ledge and hook structure at the top of the stake corresponds to that of the second and third embodiments and is designated by similar characters followed by subscripts as follows: ledge "$L_5$"; hook 44*e;* cutout 46*e;* and top surface 48*e*.

Figure 19:
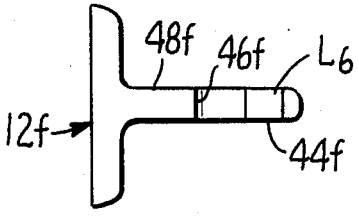
FIGS. 19 and 20 are top end and top perspective views, respectively, of a seventh embodiment stake.
Figure 20:
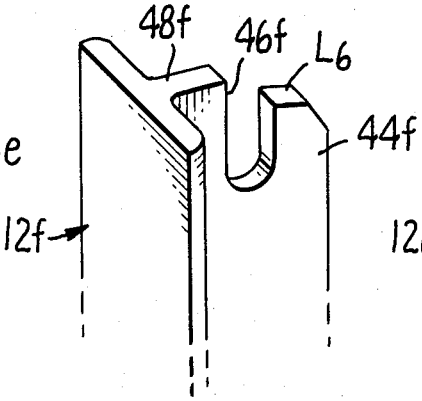

The seventh embodiment stake 12*f* illustrated in FIGS. 19 and 20 is of a T-shaped configuration. The ledge and hook structure at the top of the stake corresponds to that of the second and third embodiments and is designated by similar characters, followed by subscripts as follows: ledge "$L_6$"; hook 44*f;* cutout 46*f;* and top surface 48*f*.

Figure 21:
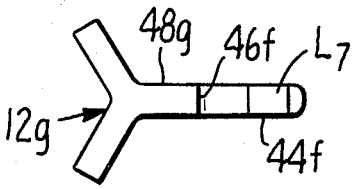
FIGS. 21 and 22 are top end and top perspective views, respectively, of an eighth embodiment of the stake.
Figure 18:
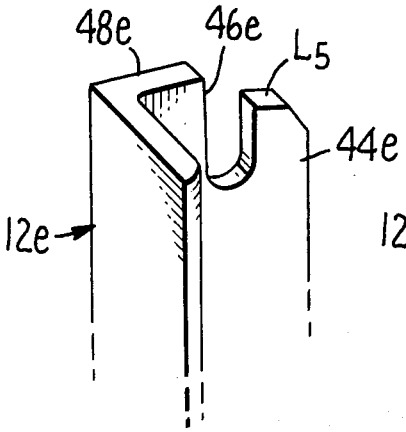
Figure 22:
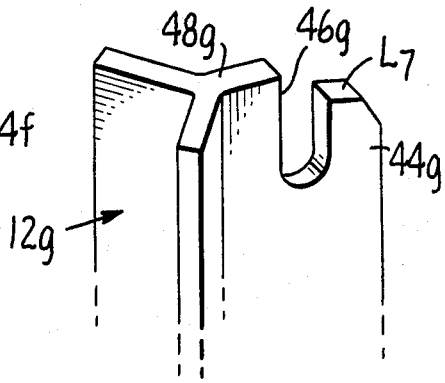

The eighth embodiment stake 12*g* illustrated in FIGS. 21 and 22 is of a Y-shaped configuration. The ledge and hook structure of the top of the stake corresponds to that of the second and third embodiments and is designated by similar characters, followed by subscripts as follows: ledge "$L_7$"; hook 44*g;* cutout 46*g;* and top surface 48*g*.

The fourth, fifth, sixth, seventh and eighth embodiments offer alternative ways of making the stake, either by folding or extrusion. They also have the advantage of having a high beam strength and of providing a symmetrical structure which avoids lateral drifting as the stakes are driven into place. The latter advantage is particularly true of the seventh and eighth embodiments.

CONCLUSION

While preferred embodiments have been illustrated and described, it should be understood that the invention is not intended to be limited to these embodiments, but rather is defined by the accompanying claims.

What is claimed is:

1. An improved strip and supporting stake construction for forming a key joint between adjacent concrete slabs, said construction comprising: a plurality of stakes adapted to be vertically set in transversely aligned relationship with the upper ends thereof disposed uniformly below grade level, said stakes each having an upwardly facing strip supporting ledge at the upper end thereof and a downwardly facing hook member intermediate the length thereof to engage a lower portion of the strip upon suspension of the strip from the stake, said hook member having a downwardly facing distal end engageable with the lower portion of the strip to maintain the strip in tension between said end and the ledge and said hook member having an angled portion extending downwardly and inwardly to said distal end providing an outer cam surface to facilitate such engagement; an elongated key joint strip adapted to be supported on the stakes, said strip having a longitudinally extending generally planar upper portion with a hook segment on one side thereof engageable with the ledges on the stakes to suspend the strip therefrom, a longitudinally extending key forming channel depending from said upper portion and extending laterally from the side thereof opposite said one side, and a longitudinally extending protrusion depending from the channel, said protrusion being positioned for alignement with the hook members upon engagement of the hook segment with the ledges and being proportioned for camming engagement with said cam surfaces and deflection to snap into locking engagement beneath the distal ends of the hook members upon being forced toward the stakes.

2. An improved construction according to claim 1 wherein: the stakes are fabricated of sheet metal and formed with a longitudinally extending reinforcement rib; the upper ends of the stakes and the ledges thereon are proportioned for receipt within the hook segment of the strip; and, the hook members comprise tabs stricken from the stakes.

3. An improved construction according to claim 2 wherein the stakes each have a plurality of said tabs positioned at vertically spaced locations to accommodate strips of different heights.

4. An improved construction according to claim 2 wherein the stakes each comprise a generally planar body portion so proportioned as to be held in a condition generally parallel to the strip upon receipt of the upper ends of the stakes within the hook segment of the strip.

5. An improved construction according to claim 1 wherein the stakes each comprise a generally planar body portion disposed to extend normal to the strip upon support of the strip on the stakes, said body portion having a recess formed intermediate the length thereof to provide said hook member and a hook formed in the upper end thereof to provide a distal end defining said ledge.

6. An improved construction according to claim 5 wherein the distal end of the hook defining the ledge is at a level beneath the top of the stake.

7. An improved construction according to claim 5 wherein the recess is hook-shaped and includes a downwardly extending distal end engageable with the longitudinally extending protrusion of the strip.

8. An improved construction according to claim 7 wherein the stakes each have a plurality of said recesses positioned at vertically spaced locations to accommodate strips of different heights.

9. An improved construction according to claim 1 wherein the protrusion comprises a rolled distal edge on the bottom of the strip extending in a lateral direction, relative to the plane of the upper planar member, opposite that in which the key forming channel extends.

10. An improved construction according to claim 9 wherein: the hook members have downwardly extending distal ends and the rolled distal edge of the bottom of the strip includes an upwardly extending portion engageable beneath said ends.

11. An improved stake for supporting a strip used to form a key joint between adjacent concrete slabs, said stake comprising: an elongated body member having an upwardly facing ledge at one end thereof proportioned for receipt within a hook segment on an upper end of a strip to suspend the strip from the ledge; and, an outwardly extending hook formed in the body member intermediate the length thereof to engage a lower portion of the strip suspended from the stake, said hook having a downwardly facing distal end engagement with the lower portion of a strip suspending from the body to maintain the strip in tension between said end and the ledge and said hook having an angled portion extending downwardly and inwardly to said distal end providing an outer cam surface to facilitate such engagement.

12. An improved stake according to claim 11 wherein the hook comprises a tab stricken from the body member and extending outwardly and downwardly therefrom.

13. An improved stake according to claim 11 wherein the hook comprises a cutout recess formed in the body member.

14. An improved stake according to claim 11 wherein a plurality of said hooks are formed in the body member at vertically spaced locations to accommodate strips of different heights.

15. An improved stake according to claim 11 wherein the body portion is generally planar and designed to extend normal to a strip supported on the stake and the ledge is defined by the distal end of a hook formed in the upper end of the body portion.

16. An improved stake according to claim 15 wherein the distal end of the hook defining the ledge is at a level beneath the top of the stake.

17. An improved stake according to claim 15 wherein the stake is of an angle-shaped cross-section with one leg of the angle defining the body portion.

18. An improved stake according to claim 17 wherein the cross-section is in the shape of a T.

19. An improved stake according to claim 17 wherein the cross-section is in the shape of a Y.

* * * * *